US006539659B2

(12) United States Patent
Casas Salva

(10) Patent No.: US 6,539,659 B2
(45) Date of Patent: Apr. 1, 2003

(54) DEVICE FOR HINGING A BARREL IN AN AIR-POWERED CARBINE OF GUN HAVING A TILTABLE BARREL

(75) Inventor: Francisco Casas Salva, Barcelona (ES)

(73) Assignee: Industrias el Gamo, SA, Sant Boi de Llobregat (ES)

( * ) Notice: Subject to any disclaimer, the term of this patent is extended or adjusted under 35 U.S.C. 154(b) by 0 days.

(21) Appl. No.: 09/976,288

(22) Filed: Oct. 15, 2001

(65) Prior Publication Data

US 2002/0056218 A1 May 16, 2002

(30) Foreign Application Priority Data

Oct. 13, 2000 (ES) ..... 2000 02464

(51) Int. Cl.[7] ..... F41A 21/00
(52) U.S. Cl. ..... 42/75.04
(58) Field of Search ..... 42/75.04; 124/66, 124/65

(56) References Cited

U.S. PATENT DOCUMENTS 4,774,929 A * 10/1988 Milliman ..... 124/76
4,883,042 A * 11/1989 Wackrow ..... 124/38
5,193,517 A * 3/1993 Taylor et al. ..... 124/65
5,205,271 A * 4/1993 Casas Salva ..... 124/65
5,400,536 A * 3/1995 Milliman ..... 124/74
5,570,676 A * 11/1996 Gore ..... 124/56
5,575,270 A * 11/1996 Casas-Salva ..... 124/67
5,632,264 A * 5/1997 Barker et al. ..... 124/67
5,655,509 A * 8/1997 Casas Salva ..... 124/66

FOREIGN PATENT DOCUMENTS

EP 0467819 B1 1/1992

* cited by examiner

*Primary Examiner*—Charles T. Jordan
*Assistant Examiner*—Jordan M Lofdahl
(74) *Attorney, Agent, or Firm*—Jacobson Holman PLLC

(57) ABSTRACT

A barrel box integral with the barrel rear end, with a hinge and latch for closing with respect to a fork integral with the front end of a pressure chamber. The box being connected to a mechanism of levers for compressing a plunger of the pressure chamber, the fork including an internal fork part obtained by molding, which concentrates most of the complex configurations, tightly fit and joined to a portion of a the mouth of the pressure chamber, which is of metal tube and tightly covers the whole of the internal fork part, the barrel box being also obtained by molding, with a rear part of the barrel as an insert.

16 Claims, 3 Drawing Sheets

DEVICE FOR HINGING A BARREL IN AN AIR-POWERED CARBINE OF GUN HAVING A TILTABLE BARREL

This invention relates to a device for hinging a barrel in an air-powered carbine or gun having a tiltable barrel, in which some of its composing elements are moulded in plastic material.

In prior art, air-powered carbines or guns are known in which the barrel is tiltable with the double aim, on one hand, to make the back end of the barrel accessible for facilitating its loading with ammunition, and on the other hand, for using the tiltable barrel itself as a lever arm for loading a thrusting spring of a plunger of an air pressure compression chamber. This tiltable barrel requires accurate hinging means and centring and locking means for the barrel in closed position securing the alignment of the bore of the said barrel with an outlet of compressed air from the said pressure chamber. The said hinging, centring and locking means involve a series of complex configurations which have to be shaped by mechanising them when the basic plates are of metal, namely steel, which means very high production costs.

EP-0 467 819, granted to this applicant, discloses improvements provided to an air-powered carbine or gun having a tiltable barrel consisting in grouping the said complex configurations into two subassemblies which can be made by moulding, typically by plastic injection moulding, cutting down thus the production costs. One of the said subassemblies is attached integral with the barrel rear part by simple coating moulding, coating at same time the whole of the said barrel. The other subassembly constitutes a fork and it is formed by an independent part made in a single moulding operation and is designed to be attached integral with the pressure chamber front part by tight insertion locked by means of pins. For this aim, this second subassembly comprises a cylindrical part which is designed to be inserted in the pressure chamber front part, and a part which configures the said fork with holes for a hinging pin with respect to the first subassembly integral with the barrel.

Although this kind of moulding construction allows lower production costs, it still has some drawbacks which ask for a solution. As for the first subassembly, the fact of carrying out a coating moulding on the whole of the barrel length requires very large-sized moulds and providing a great amount of moulding material, which is still meaning a high production cost. As for the second subassembly, the whole of the plastic part forming the said fork is overhanging with respect to the metal tube forming the pressure chamber, showing a transition neck between the said fork part and the cylindrical part inserted in the said metal tube. Stresses produced in the material because of repeated efforts tends to be concentrated in this neck or transition area therefore the part can be bent or even broken at this point due to fatigue.

Therefore, the object of this invention is to provide a hinging device for a barrel in an air-powered carbine or gun having a tiltable barrel which comprises complex configurations grouped in two groups which can be obtained by moulding, and that the production is less expensive and more strong than the hinging devices of the prior art.

This object is achieved, according to this invention, providing a hinging device for a barrel in an air-powered carbine or gun having a tiltable barrel of the kind comprising a barrel box integral with the barrel rear end, the said barrel box comprising a hole for a hinging pin and a latch designed respectively for hinging and closing the barrel in a fork integral with the front end of an air pressure chamber, the said barrel box being connected to a mechanism of hinged levers adapted for compressing a thrusting spring of a plunger of the pressure chamber, using for this the barrel as a lever arm when it is lowered. The device of this invention is characterized in that the said fork comprises an internal fork part, obtained by moulding, preferably of a plastic material provided with two front branches and a rear end portion tightly inserted and joined in a portion of mouth of the said pressure chamber, which in turn is forwardly extended in two side blades which are arranged closely covering the said two front branches of the said internal fork part.

With this arrangement it is achieved to concentrate in the said internal fork part obtained by moulding, all the more complex configurations, such as the said front branches, holes for the pins, at least one external perimetric slot for containing an annular sealing element, a longitudinal hole for the passage of the air from the pressure chamber, a retaining configuration for the said latch with the barrel at a closed position, among others, while the branches of the fork remain covered and externally strengthened by the said side blades of the said portion of mouth of the pressure chamber, which are obtained by simply cutting the metal tubular material itself of which the pressure chamber is an integral part. The said mouth portion includes other characteristics which in every case are simple holes easy to mechanise. In addition, from the internal fork part moulded in plastic material any neck shape disappeared which could concentrate stresses in a maximum bending area, as it occurred in the device of the said document EP-0 467 819.

On the other hand, the device of this invention provide a barrel box obtained by moulding, preferably by injection moulding a plastic material, embedding the barrel rear portion as an insert. Thus, the said barrel box obtained by moulding comprises those complex configurations such as holes for pins, notches, a longitudinal recess, open at the rear part, for slidingly housing the said latch and in addition also an anchoring configuration for an adjustable rearsight, while at the said rear portion of the barrel, it only includes some planes on its external surface easy to mechanise. The fact of only injecting the barrel box on the barrel rear portion as an insert, without fully coating the whole of the barrel length, as it occurs in the device of document EP-0 467 819, allows to obtain results equivalent with very smaller sized moulds and with less plastic material being used and therefore a lower cost.

The invention will be best understood from following detailed description of an example of embodiment, which includes references to the accompanying drawings, in which.

Figure 1:
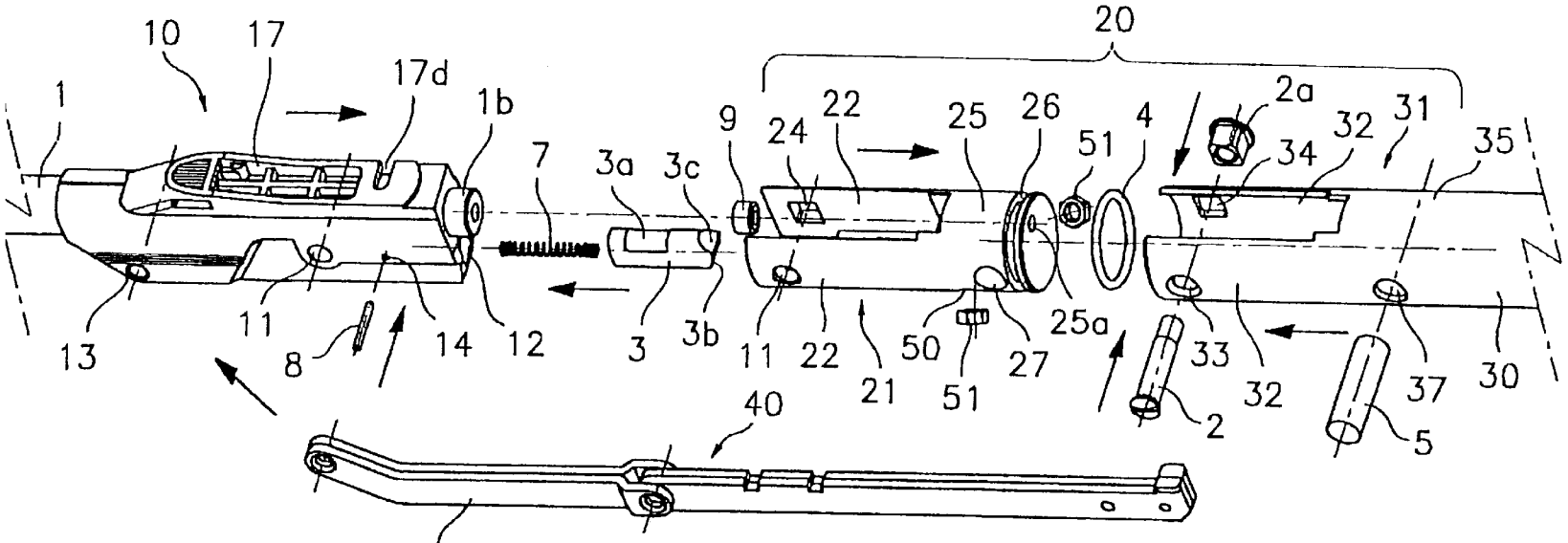
FIG. 1 is an exploded view in perspective of the hinging device of a barrel of an air-powered carbine or gun having a tiltable barrel according to the invention.

First referring to FIG. 1, the hinging device of a barrel of an air-powered carbine or gun having a tiltable barrel of this invention is of the kind comprising a barrel box 10 integral with the barrel 1 rear end, the said barrel box 10 comprising a cross through hole 11 for a hinging pin 2, designed to hinge the barrel 1 and a latch 3 designed to close it in a fork 20, integral with the front end of an air pressure chamber 30. The said barrel box 10 is connected to a mechanism of hinged levers 40 adapted for compressing a thrusting spring of a plunger (not shown) of the pressure chamber 30. With this arrangement, it is possible to lower the barrel 10 to facilitate loading the ammunition in it, at same time that the barrel 1 itself, as it is lowered, is used as a lever arm for loading the said spring of the plunger of the pressure chamber 30 for storing energy in the form of compressed air adapted for being released in the moment of shooting for impelling the projectile through the internal bore of the barrel 1 brought back to a closed position.

An essential characteristic of this invention is that the said fork 20 comprises an internal fork part 21, obtained by moulding, which has two front branches and a rear external portion tightly inserted and joined to a portion of mouth 31 of the said pressure chamber 30, which in turn is forwardly extended forming two side blades which are arranged tightly covering the said two front branches of the said internal fork part 21. This arrangement allows to concentrate in the said internal fork part 21 all those more complex configurations, which will be explained below, which are easily to obtain by moulding, preferably by injection moulding of a plastic material with fillers, at same time that most of the efforts are supported by the said portion of the mouth 31 of the pressure chamber 30 and by the said side blades forming a whole with it, which is obtained from a metal tube through a simple mechanisation, and tightly covers the whole of the internal fork part 21 moulded.

Figure 3:
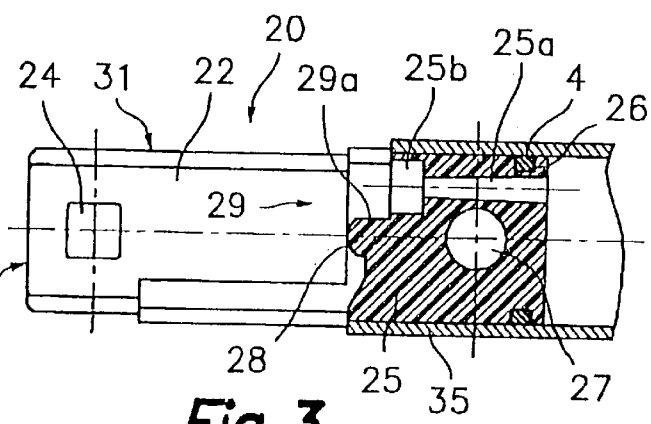
FIG. 3 is a side view of a central longitudinal section of the fork of FIG. 1 being assembled.

The said two front branches of the said internal fork part 21 comprise two ears 22, which have holes 23, 24 facing each other, adapted for receiving the said hinging pin 2. One of these holes 24 has a polygonal section, such as a square, for being coupled to a related cross section nut 2*a*, for a threaded end of the hinging pin 2, in order to prevent that it rotates when screwed. The said rear external portion of the said internal fork part 21 comprises a cylindrical part 25 provided with at least an external perimetric slot 26 for housing an annular sealing element, such as a O-ring 4, designed to prevent compressed air leaks from the pressure chamber 30. The said cylindrical part 25 also comprises, as it is best shown in FIG. 3, at least a cross hole 27 for a mounting pin 5 in the said mouth 31 portion, a longitudinal hole 25*a* for the passage of the air from the pressure chamber 30 and a retaining configuration 28 located on a front surface 29, formed between the said ears 22, for retaining the said latch 3 with the barrel 1 in closed position. The said longitudinal hole 25*a* for the passage of the air is slightly tapered, ending by its narrowest part in a cylindrical countersinking 25*b* arranged on the said front surface 29, in which cylindrical countersinking 25*b* a leak-tight sleeve 9 with respect to the barrel 1 is housed when it is in closed position.

On the other hand, the said side blades extending from the mouth portion 31 of the pressure chamber 34 comprise two portions of front ear 32 provided with holes 33, 34, coincident in their shape and position respectively with the said holes 23, 24 of the ears 22 of the internal fork part 21, being adapted as a whole for receiving the said hinging pin 2. The said mouth portion 31 in addition comprises a rear tubular part 35, integral with the said pressure chamber 30, provided with a cross hole 37 for the said mounting pin 5 of the internal fork part 21 through its corresponding cross hole 27.

Another characteristic of this invention is mentioned barrel box 10 integral with the barrel 1 rear end which is obtained by moulding embedding the rear portion 1*a* of the barrel 1 as an insert. Also here, the part obtained by moulding, preferably by injection moulding of a plastic material with fillers, concentrates all those complex configurations, disclosed below, which otherwise would be very expensive to be obtained by mechanisation, being supported an part 1*a* as an insert, and the protruding part 1*b* of the barrel 1, which is typically metallic, only a few very simple configurations easy to mechanise.

Figure 2:
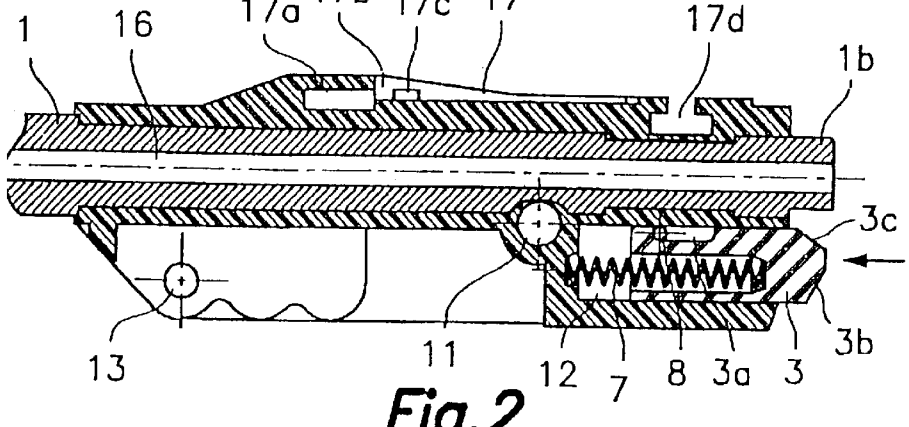
FIG. 2 is a side view in longitudinal central section of the barrel box of the device of FIG. 1 with an assembled latch.

This barrel box 10, also shown in FIG. 2 in more details, comprises, in addition to the said hole 11 for the said hinging pin 2, a longitudinal recess 12, open at the rear part, for slidingly housing the said latch 3 and a hole 13 for a hinging hole with respect to a first lever 41 of the said mechanism of hinged levers 40. The longitudinal recess 12 includes means for outwardly pushing and for retaining the latch 3 in it which comprise a compressing spring 7, arranged between the bottom of the longitudinal recess 12 and the rear part of the latch 3 and a pin 8 housed in cross holes 14 of the barrel box 10, in such a position that, as it is best shown in FIG. 2, the said pin 8 remains crossed within the longitudinal recess 12 in a hollow left by an elongated offset 3*a* of the latch 3, the said latch 8 limits the slidingly travel of the latch 3 stopped on the ends of the elongated offset 3*a*. When the barrel 1 is closed on the fork 20, an inclined lower surface 3*b* of the end of the latch 3 temporarily slides on the said retaining configuration 28 of the fork 20 moving the latch 3 internally the said recess 12 until, after overcoming the retaining configuration 28, the spring 7 outwardly pushes the latch 3 and a top inclined surface 3*c* of the end thereof is interlocked under the retaining configuration 28. For opening the barrel the reverse process is carried out.

For keeping a correct alignment of the longitudinal bore 16 of the barrel 1 with the said longitudinal hole 25*a* for the passage of the air from the said internal fork part 21 when the barrel 1 is at the closed position, the said front surface 29, formed between the said ears 22 in addition comprises a seat 29*a* for a portion of the barrel 1*b* protruding from the rear part of the barrel body 10 when the barrel 1 is at the said closed position, the said seat 29*a* limiting the possible sidewards and downwards moves of the said protruding barrel portion 1*b* while the latch 3 interlocked in the retaining configuration 28 prevents an upwards move of it.

Figure 5:
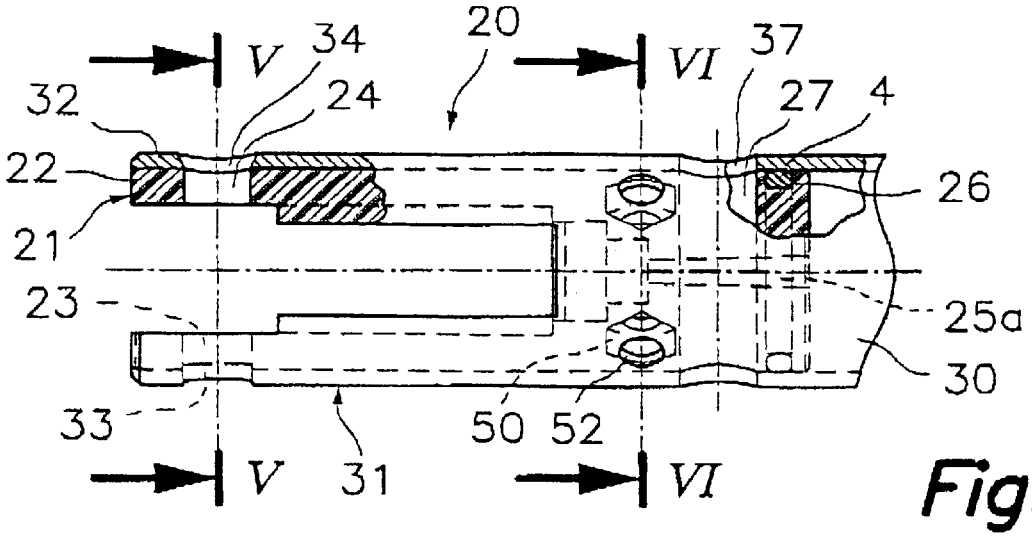
FIG. 5 is a lower plan view of the fork being assembled of FIG. 2 with some sectioned parts.
Figure 6:
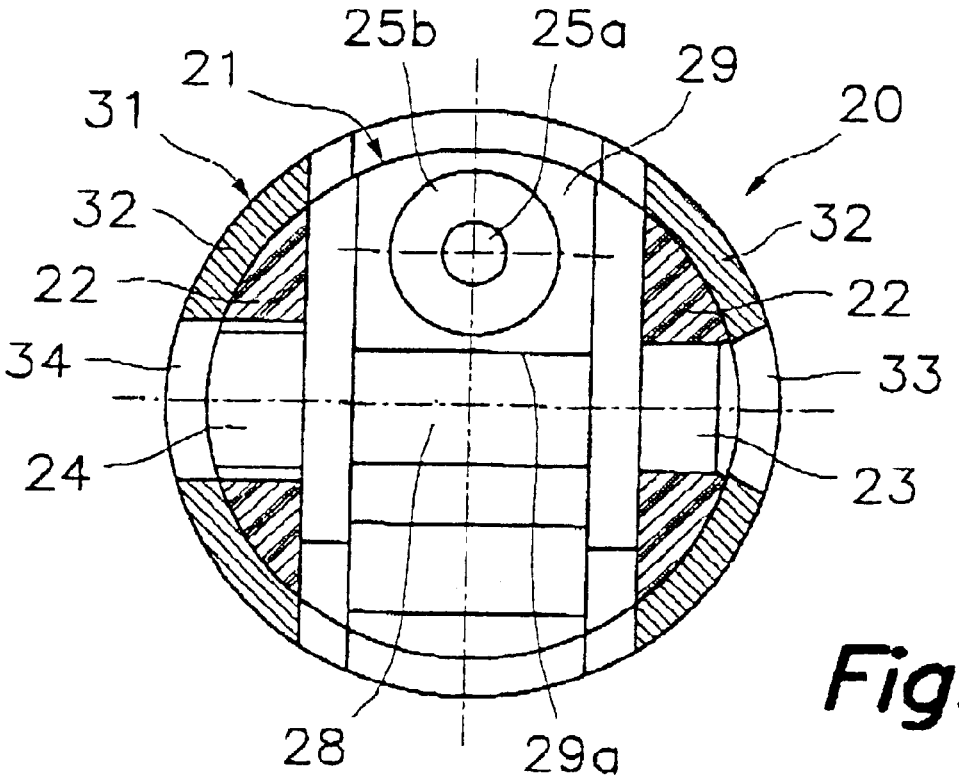
FIG. 6 is an enlarged scale view of a cross section taken along plane V—V of FIG. 5.
Figure 7:
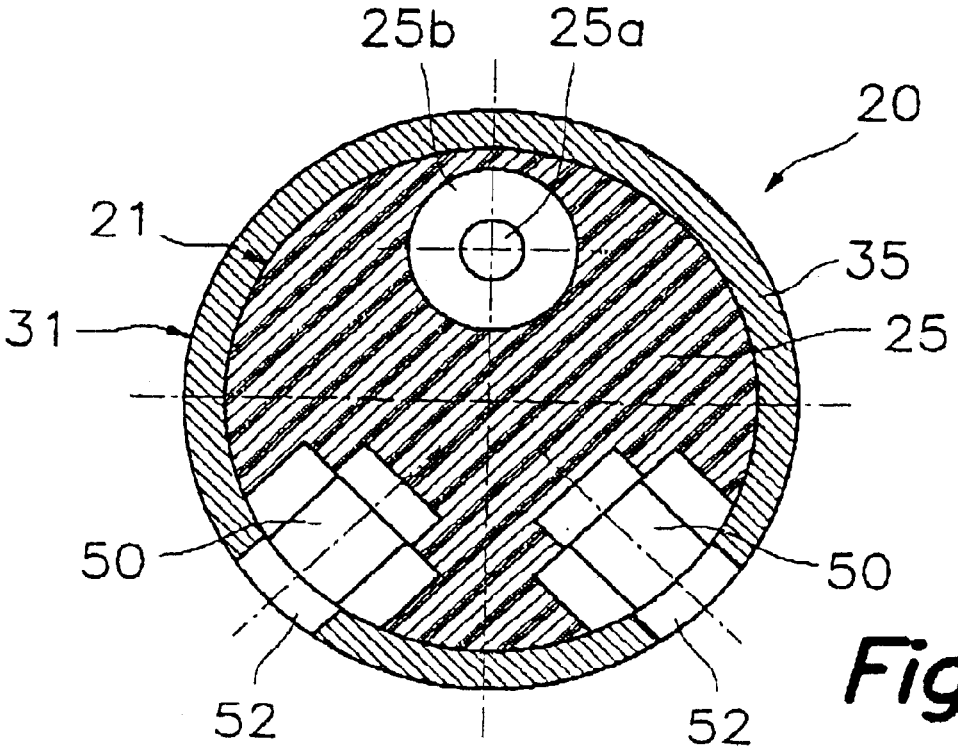
FIG. 7 is an enlarged scale view of a cross section taken along plane VI—VI of FIG. 5.

The internal fork part 21 in addition comprises as best illustrated in FIGS. 5 and 7, two housings 50 having a polygonal outline, such as hexagonal and sufficient depth for housing polygonal nuts 51, typically hexagonal nuts, which, once the internal fork part 21 and the mouth portion 31 of the pressure chamber 30 have been assembled, they remain retained in the said housings 50 by the walls of the rear tubular part 35 of the mouth 31 and are prevented to rotate by the fitting of its polygonal shape in the said polygonal outline of the housings 50. On the other hand, at the said tubular part 36 through holes 52 are arranged which, with the assembled fork, coincide with the threaded hole of the said nuts 51, allowing the passage of setscrews (not shown) of the device to the body of a butt end and screwing the said nuts 51. This way, when screwing the said screws, the said nuts 51 internally press against the metal tubular part 35 avoiding the requirement to pierce threaded holes in the plastic material of the internal fork part 21 for screwing the said screws, which as it is known, provide a very weak junction. As well the through holes 51 as the recesses 50 are preferably located according to a radial orientation, in angular positions symmetric with respect to a longitudinal vertical plane of the carbine or gun.

Another complex configuration including at its top part the said barrel body 10 obtained by moulding is an anchoring housing 17 for an adjustable rearsight. This housing 17 comprises, at a front part, a recess 17*a* for receiving inserted an end of the resilient tongue of the rearsight (not shown), side walls 17*b* for flanking at least an area close to the said end of the tongue and side stops 17*c* close to the said recess 17*a*, which can be fitted in grooves of the said tongue to lock it. The top part of the barrel body 10 also includes, at a rear part, a cross guide 17*d* of a known kind, for introducing a base of a setscrew of the rearsight.

Figure 4:
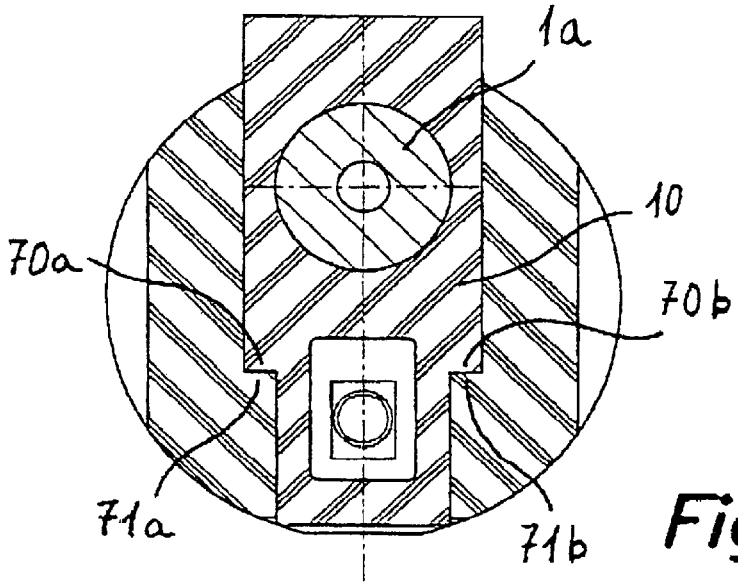
FIG. 4 is an enlarged scale view of a cross section of the end portion of the barrel box fitted in the fork in a closed condition according to an alternative embodiment.

According to an alternative embodiment shown in FIG. 4, the end of the rear portion 1*a* of the barrel 1 is flushed with the casing barrel box 10 and it has on its two sides and near its lower side respective wide, elongated recesses 70*a*, 70*b* in the longitudinal direction of the barrel, said recesses being able to fit lean in a closed condition on corresponding shoulders 71*a*, 71*b* in the inner wall of each branch of the fork with perfect alignment between the barrel and the said longitudinal hole 25*a* for the passage of compressed air.

It must be stated that above disclosed example of embodiment, is given only for illustration purpose, therefore in no way it can be interpreted with a criterion limiting the scope of the protection which is applied for, which is defined in claims attached.

What is claimed is:

1. Device for hinging a barrel in an air-powered carbine or gun having a tiltable barrel comprising a barrel box integral with the barrel rear end, the barrel box comprising a hole for a hinging pin and a latch designed respectively for hinging and closing the barrel in a fork integral with the front end of an air pressure chamber, the barrel box being connected to a mechanism of hinged levers adapted for compressing a thrusting spring of a plunger of the pressure chamber, using the barrel as a lever arm when it is lowered, the fork comprises an internal fork part, obtained by moulding, provided with two front branches and a rear end portion tightly inserted and joined in a portion of mouth of the pressure chamber, which in turn is forwardly extended in two side blades which are arranged closely covering the two front branches of the internal fork part, the front branches of the internal fork part comprise two ears, which have holes facing each other, adapted for receiving the hinging pin, while the rear end portion comprises a cylindrical part provided with at least an external perimetric slot for housing an annular sealing element, at least a cross hole for a mounting pin in the mouth portion, a longitudinal hole for the passage of the air from the pressure chamber and a retaining configuration located on a front surface, formed between the ears, for retaining the latch with the barrel in closed position, and the side blades of the mouth portion of the pressure chamber comprise two portions of front ears provided with holes coinciding respectively with the holes of the ears of the internal fork part, adapted for receiving the hinging pin, the mouth portion in addition comprising a rear tubular part, integral with the pressure chamber provided with a cross hole for the setscrew of the internal fork part.

2. Device, according to claim 1, wherein the barrel box integral with the barrel rear end is obtained by moulding embedding a rear portion of the barrel as an insert, the barrel box comprises in addition to the hole for the hinging pin a longitudinal recess open at the rear part, for slidingly housing the latch, including means outwardly pushing and retaining the latch, and a hole for a hinging pin with a first lever of the mechanism of hinged levers.

3. Device according to claim 2, wherein the end of the rear portion of the barrel is flushed with the casing barrel box and has on two sides and near a lower side respective wide, elongated recesses in the longitudinal direction of the barrel, said recesses being able to fit lean in a closed condition on corresponding shoulders in the inner wall of each branch of the fork with perfect alignment between the barrel and the longitudinal hole for the passage of compressed air.

4. Device according to claim 2, wherein the front surface formed between the ears in addition comprises a seat for a portion of the protruding barrel of the rear part of the barrel body when the barrel is at the closed position, the seat and protruding barrel portion cooperating to keep a correct alignment of the longitudinal bore of the barrel with the longitudinal hole for the passage of the air from the internal fork part when the barrel is at the closed position.

5. Device, according to claim 1, wherein the cylindrical part of the internal fork part comprises two housings having a polygonal outline and sufficient depth for housing polygonal nuts, which remain retained in the housings by the rear tubular part of the mouth and are prevented to rotate by the fitting of its polygonal shape in the polygonal outline of the housings, at the tubular part through holes are arranged which, with the assembled fork, coincide with the threaded hole of the nuts, allowing the passage of setscrews of the device to the body of a butt end.

6. Device, according to claim 1, wherein the longitudinal hole for the passage of air from the internal fork part is slightly tapered, ending by a narrowest part in a cylindrical countersinking arranged on the front surface, in which cylindrical countersinking a leak-tight sleeve with respect to the barrel is housed when it is in a closed position.

7. Device, according to claim 2, wherein the means outwardly pushing and retaining the latch in the longitudinal recess comprise a compressing spring, arranged between the bottom of the longitudinal recess and the rear part of the latch and a pin housed in cross holes of the barrel box, in such a position that the pin remains crossed within the longitudinal recess in a hollow left by an elongated offset of the latch, the latch limits the slidingly travel of the latch stopped on the ends of the elongated offset.

8. Device, according to claim 2, wherein the barrel body includes, at a top part, an anchoring housing for a detachable, adjustable rearsight, the housing comprises, at a front part, a recess for an end of a resilient tongue of the rearsight, side walls for flanking at least an area close to the end of the tongue and side stops close to the recess, which can be fitted in grooves of the tongue to lock it, on the top part of the barrel body, at a rear area of the top part of the barrel body, a cross guide for a base of a setscrew of the rearsight.

9. Device, according to claim 1, wherein the internal fork part obtained by moulding is obtained by injection moulding a plastic material provided with fillers.

10. Device, according to claim 2, wherein the barrel box obtained by moulding with a rear portion of the barrel embedded as an insert is obtained by injection moulding a plastic material provided with fillers.

11. Device for hinging a barrel in an air-powered carbine or gun having a tiltable barrel comprising a barrel box integral with the barrel rear end, the a barrel box comprising a hole for a hinging pin and a latch designed respectively for hinging and closing the barrel in a fork integral with the front end of an air pressure chamber, the barrel box being connected to a mechanism of hinged levers adapted for compressing a thrusting spring of a plunger of the pressure chamber, using the barrel as a lever arm when it is lowered, the fork comprises an internal fork part, obtained by moulding, provided with two front branches and a rear end portion tightly inserted and joined in a portion of a mouth of the pressure chamber, which in turn is forwardly extended in two side blades which are arranged closely covering the two front branches of the internal fork part, the barrel box integral with the barrel rear end being obtained by moulding embedding a rear portion of the barrel as an insert, the barrel box comprises in addition to the hole for the hinging pin a longitudinal recess open at the rear part, for slidingly housing the latch, including means outwardly pushing and retaining the latch, and a hole for a hinging pin with a first lever of the mechanism of hinged levers.

12. Device according to claim 11, wherein the end of the rear portion of the barrel is flushed with the casing barrel box and has on two sides and near a lower side respective wide, elongated recesses in the longitudinal direction of the barrel, said recesses being able to fit lean in a closed condition on corresponding shoulders in the inner wall of each branch of the fork with perfect alignment between the barrel and the longitudinal hole for the passage of compressed air.

13. Device according to claim 11, wherein the front surface formed between the ears in addition comprises a seat for a portion of the protruding barrel of the rear part of the barrel body when the barrel is at the closed position, the seat and protruding barrel portion cooperating to keep a correct alignment of the longitudinal bore of the barrel with the longitudinal hole for the passage of the air from the internal fork part when the barrel is at the closed position.

14. Device, according to claim 11, wherein the means outwardly pushing and retaining the latch in the longitudinal recess comprise a compressing spring, arranged between the bottom of the longitudinal recess and the rear part of the latch and a pin housed in cross holes of the barrel box, in such a position that the pin remains crossed within the longitudinal recess in a hollow left by an elongated offset of the latch, the latch limits the slidingly travel of the latch stopped on the ends of the elongated offset.

15. Device, according to claim 11, wherein the barrel body includes, at a top part, an anchoring housing for a detachable, adjustable rearsight, the housing comprises, at a front part, a recess for an end of a resilient tongue of the rearsight, side walls for flanking at least an area close to the end of the tongue and side stops close to the recess, which can be fitted in grooves of the tongue to lock it, on the top part of the barrel body, at a rear area of the top part of the barrel body, a cross guide for a base of a setscrew of the rearsight.

16. Device, according to claim 11, wherein the internal fork part obtained by moulding is obtained by injection moulding a plastic material provided with fillers.

* * * * *